US006003679A

United States Patent [19]

Maroscher et al.

[11] Patent Number: 6,003,679

[45] Date of Patent: Dec. 21, 1999

[54] SIEVING DEVICE WITH DUEL INDEPENDENT FREQUENCY INPUT

[76] Inventors: Victor William Maroscher, 3881 Leetonia Rd., Leetonia, Ohio 44431; Dennis Keith Ulrich, 1495 E. State St., Salem, Ohio 44460; Frederick T. Kidder, 7686 St. Rte. 164, Lisbon, Ohio 44432

[21] Appl. No.: 08/852,593

[22] Filed: May 7, 1997

[51] Int. Cl.[6] ..... B07B 1/38; B07B 1/34; B07B 1/44

[52] U.S. Cl. ..... 209/332; 209/326; 209/366.5; 209/367

[58] Field of Search ..... 209/332, 331, 209/326, 325, 320, 366.5, 367, 364

[56] References Cited

U.S. PATENT DOCUMENTS

| | | | |
|---|---|---|---|
| 801,825 | 10/1905 | Cihalewski | 209/332 |
| 2,284,671 | 6/1942 | Meinzer | 209/366.5 |
| 2,532,415 | 12/1950 | Lindblad | 209/366.5 |
| 3,206,029 | 9/1965 | Hurst | 209/366.5 |
| 3,501,002 | 3/1970 | Talley | 209/332 |
| 3,954,604 | 5/1976 | Krause et al. | 209/325 |
| 4,077,873 | 3/1978 | McKibben | 209/366.5 |
| 4,152,255 | 5/1979 | Musschoot | 209/364 |
| 4,169,055 | 9/1979 | Lydford . | |
| 4,482,455 | 11/1984 | Humphrey | 209/366.5 |
| 4,795,552 | 1/1989 | Yun et al. | 209/366.5 |
| 4,816,144 | 3/1989 | Monteith . | |
| 5,037,535 | 8/1991 | Bruderlein | 209/331 |
| 5,143,222 | 9/1992 | Monteith . | |
| 5,271,504 | 12/1993 | Bowen et al. | 209/320 |
| 5,542,548 | 8/1996 | Senapati . | |

*Primary Examiner*—Joseph E. Valenza
*Assistant Examiner*—Joe Dillon, Sr.
*Attorney, Agent, or Firm*—Sand & Sebolt

[57] ABSTRACT

A sieving device includes a sieve having a base, a drum and a main rim. A screen assembly having a mesh screen and a screen frame extending around a periphery of the mesh screen is resiliently mounted within the main rim. A low frequency vibrational drive vibrates the sieve at low frequencies. An ultrasonic vibrational probe rests on the screen frame free of rigid attachment thereto and vibrates the mesh screen around a periphery thereof. The ultrasonic vibrational drive includes an ultrasonic processor which drives the ultrasonic probe. A probe tip of the probe extends through a side wall of the main rim and rests on a top surface of the screen frame vibrating the screen from the periphery of the screen inwardly to sieve a particulate material. An alternative embodiment has a tab which extends outwardly from the screen frame. The probe tip extends through the sidewall of the main rim and through a sidewall of the drum to abut the tab.

12 Claims, 5 Drawing Sheets

SIEVING DEVICE WITH DUEL INDEPENDENT FREQUENCY INPUT

BACKGROUND OF THE INVENTION

1. Technical Field

Generally, the invention relates to a sieving device. Particularly, the inventions relates to a sieving device having a screen and a screen frame extending around a periphery of the screen which uses an ultrasonic drive to vibrate the screen at high frequencies. Specifically, the invention relates to a sieving device in which an ultrasonic probe rests on the screen frame to vibrate the screen at a periphery thereof.

2. Background Information

Traditional sieving devices typically include a base, a frame resiliently mounted on the base and a screen or screens extending across the frame. A low frequency vibratory drive in the speed range of 8 Hz to 30 Hz is mounted to the frame and includes eccentric weights. Specific vibratory motions are established in the frame by the low frequency vibratory drive generating screen accelerations up to a range of 7 g.

These prior sieving devices have been used for screening fine materials and powders. Stainless steel woven mesh screens are usually stretched tightly and attached to the screen frame. The vibration of these sieving devices typically enhances gravity separation of particles presented to the screen. Where fine particles are to be sieved, the vibration also has a negative effect in that the fine particles become suspended above a boundary layer formed above the vibrating screen.

These fine particles can be sieved through the mesh screens by vibrating the screen or screen frame relative to the base at high frequencies using an ultrasonic drive or device. These ultrasonic devices include an electromechanical transducer, the body of which is rigidly mounted with respect to the frame and is coupled to the screen by a metal probe. The low frequency vibration of the screen effected by the oscillation of the frame serves for bulk movement of the material on the screen allowing all layers of material to be presented to the screen, while the high frequency vibration of the screen effected by the ultrasonic device serves to prevent blinding of the apertures of the screen otherwise caused by material adhering to the screen or by particles of the material locking together to bridge the apertures of the mesh screen. These ultrasonic vibrating probes are typically mounted to separator frames with a direct mechanical attachment. The separator frames are directly attached to the screens at the centers thereof. Alternatively, ultrasonic devices have been bonded directly to the screen.

One problem with these prior art sieving devices is that the fine mesh screens tend to weaken in structure as the ultrasonic vibration is applied directly thereto. Also, with the vibrational probe attached directly to a center of the screen, the ultrasonic vibrations tend to dissipate and attenuate after traveling only a short distance from the center attachment and fail to adequately vibrate the peripheral outer portion of the mesh screen. As the vibrations travel from the center of the screen outwardly, the radial surface area of the screen increases dispersing and attenuating the vibrational waves. Further, sieving devices having the ultrasonic probe attached to a center of the screen must have supports and wires extending from the periphery to the center of the screen to drive the probe. The material being sieved through the mesh screen accumulates on these supports and wires after it passes through the screen. This accumulation of material must be cleaned from the supports and wires and often is not salvageable for its intended use.

One patent which attempts to address this problem of dissipation and attenuation of vibrational energy caused by the center attachment is U.S. Pat. No. 5,542,548 which discloses a screening system with a resiliently mounted frame having a screen extending there across. The ultrasonic probe of this prior art sieving device is rigidly attached to a separator frame in one embodiment and directly and rigidly attached to the screen frame in a second embodiment.

Although this prior art sieving device is adequate for the purpose for which it is intended, the rigid attachment between the ultrasonic probe and the sieving frame or screen frame may be difficult to replace in the event that the ultrasonic probe breaks or malfunctions. Additionally, the sieving frame or screen frame must be specially manufactured to include the rigid attachment of the ultrasonic probe thereto or the ultrasonic probe must be welded or otherwise secured to the sieving frame or screen frame.

Therefore, the need exists for a sieving device which vibrates the screen frame around the periphery of the mesh screen at high frequencies using an ultrasonic device, in which the probe of the ultrasonic device rests or lays on the screen frame free of rigid attachment thereto and which is easily retrofit to existing sieves.

SUMMARY OF THE INVENTION

Objectives of the invention include providing an improved sieving device which causes a vibration of the mesh screen at ultrasonic high frequencies as well as low frequencies.

Another objective is to provide a sieving device which vibrates the screen frame extending around a periphery of the mesh screen.

A further objective is to provide a sieving device in which an ultrasonic probe merely rests on the screen frame to vibrate the screen frame at the ultrasonic high frequency.

A still further objective is to provide a sieving device in which the probe is free of rigid attachment to the screen frame.

Another objective is to provide a sieving device in which the ultrasonic drive is easily retrofit to existing sieves.

A still further objective is to provide a sieving device which is of simple construction which achieves the stated objectives in a simple, effective and inexpensive manner, which solves problems and satisfies needs existing in the art.

These objectives and advantages are obtained by the sieving device of the present invention the general nature may be stated as including a sieving device comprising: a base; a drum resiliently mounted on the base; a low frequency drive positioned within the base and attached to the drum; a rim mounted on the drum; a screen assembly positioned within the rim, said screen assembly includes a mesh screen and a frame having a top surface, said frame extends around a periphery of said mesh screen; and ultrasonic vibrational means which abuts the frame within an interior of the rim for vibrating the mesh screen assembly at an ultrasonic frequency.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
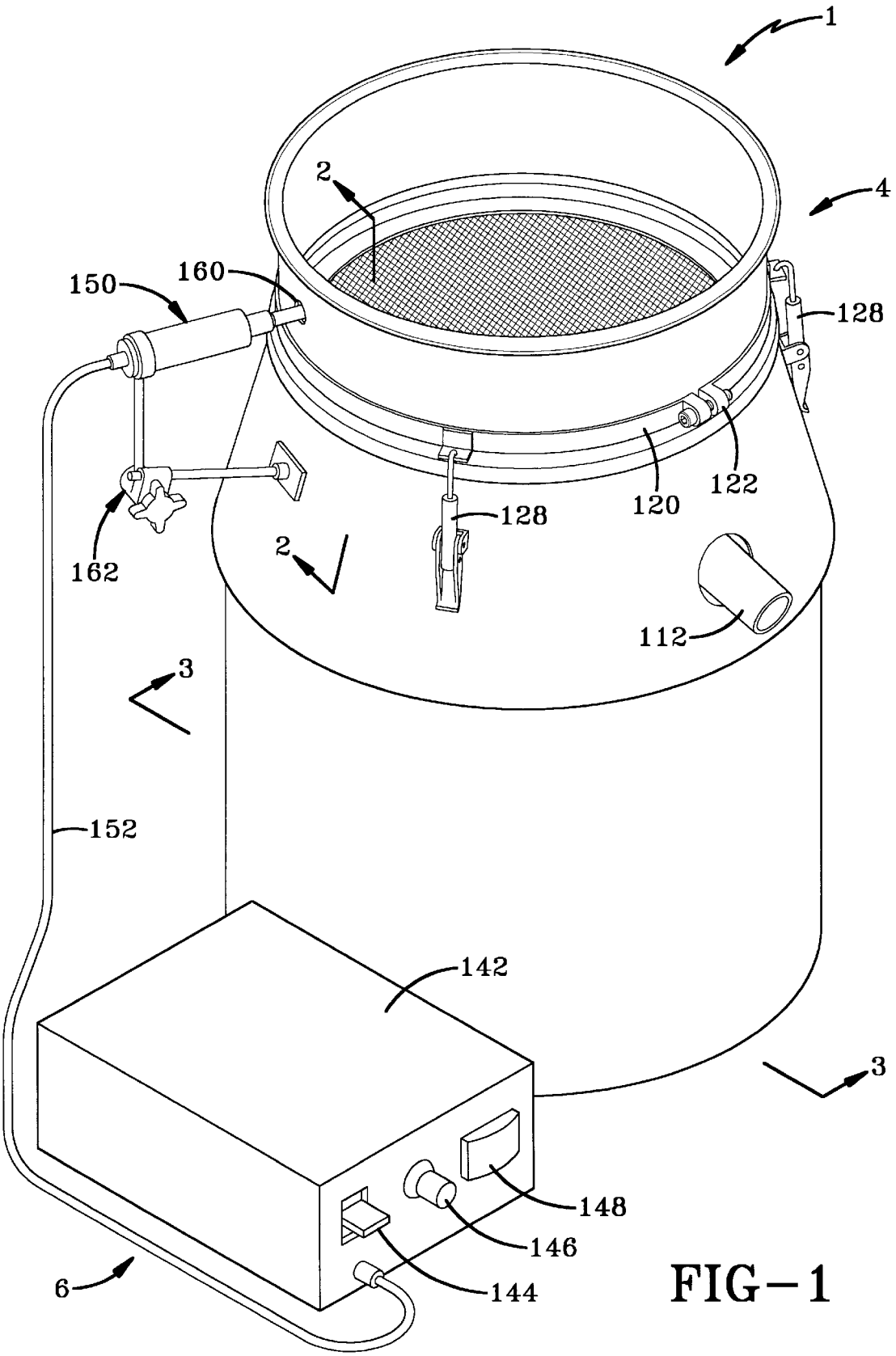
FIG. 1 is a perspective view of the sieving device of the present invention.
Figure 3:
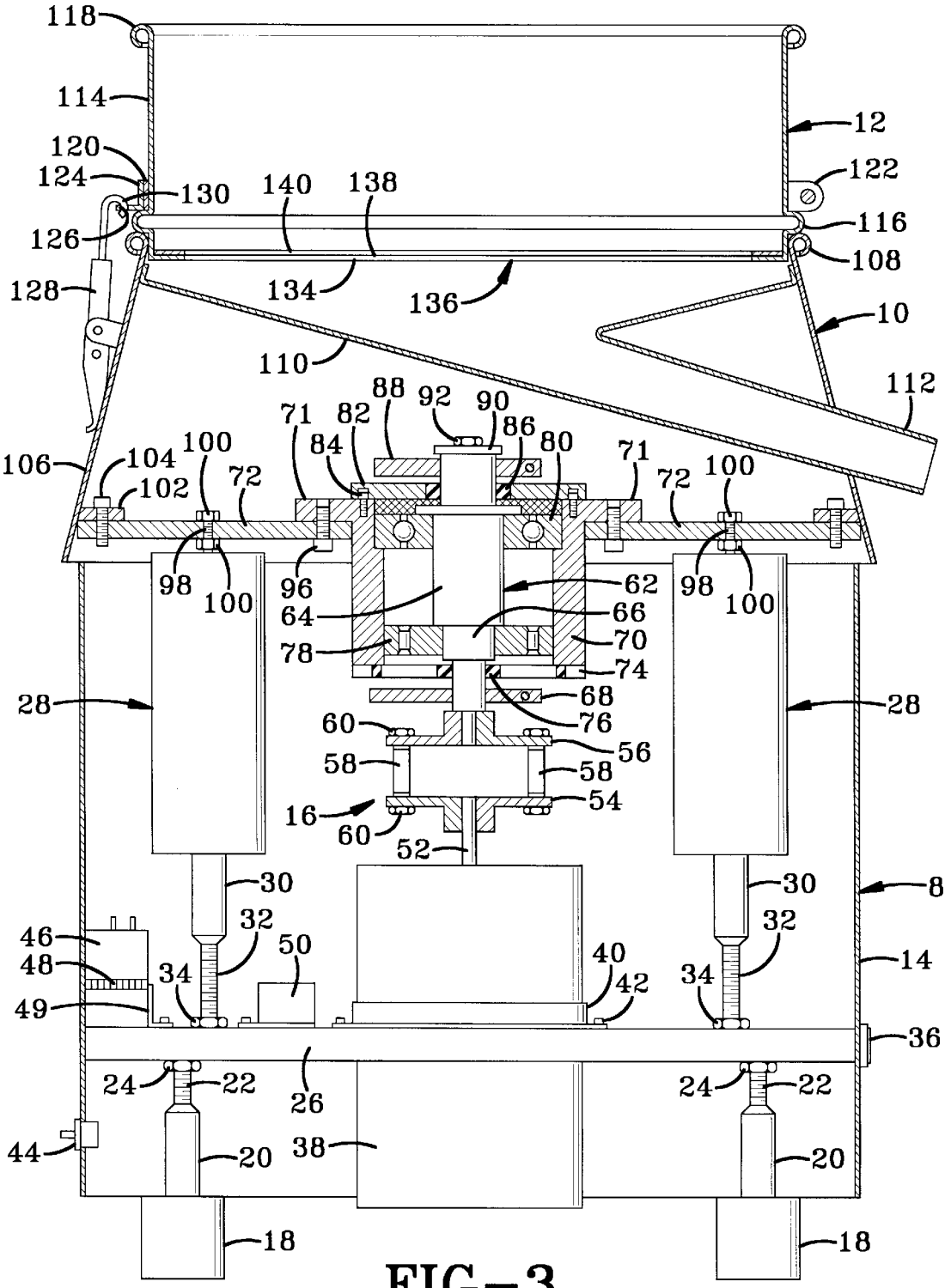
FIG. 3 is a sectional view taken along line 3—3, FIG. 1.

The sieving device of the present invention is indicated at 1 in FIG. 1 and generally includes a sieve 4 and an ultrasonic vibrational drive 6. Sieve 4 is generally cylindrical shaped and includes a base 8 (FIG. 3), a top sieve weldment or drum 10 which is supported on a top of base 8 and a main rim 12 which is supported on a top of drum 10. Base 8 includes a cylindrical side cover 14 which houses a low frequency vibrational drive 16. A pair of rubber feet 18 are attached to a bottom of base 8 to support sieve 4 on a horizontal support surface. A pair of foot extensions 20 extend upwardly from above rubber feet 18 and include a threaded shaft 22 and a lock nut 24 which are used to adjust the vertical height of foot extensions 20. A base plate 26 rests horizontally on foot extensions 20 and supports a pair of suspension mounts 28 thereon. Each suspension mount 28 includes a suspension mount extension 30 extending downwardly from the bottom of suspension mount 28 and having a threaded shaft 32 and lock nut 34 which rests on base plate 26. A side cover clamp 36 extends from the outer surface of side cover 14 to base plate 26 to secure side cover 14 in its cylindrical configuration.

A motor 38 drives low frequency vibrational drive 16 and is mounted to base plate 26 by a motor bracket 40 which is attached to base plate 26 by a plurality of bolts 42. An on/off switch 44 is electrically connected to a capacitor 46 which is held in place by a capacitor clamp 48 and a capacitor bracket 49. A relay 50 is connected to capacitor 46 and is driven by on/off switch 44 to switch motor 38 between an operative and an inoperative state. Motor 38 rotates a drive shaft 52 which is connected to a motor flange 54. Motor flange 54 is connected to an upper flange 56 by a plurality of drive studs 58 and nuts 60 tightened to each end of drive studs 58. A main shaft 62 having an upper circlip 64 and a lower circlip 66 is attached to upper flange 56 and is rotated by motor 38 as described below.

A lower eccentric weight 68 is attached to lower circlip 66 slightly above upper flange 56 to vibrate sieve 4 when weight 68 is rotated by motor 38. Main shaft 62 rotates within a bearing housing 70 which includes an annular flange 71 and which is rigidly mounted to suspension mounts 28 by a bearing housing plate 72. Bearing housing 70 includes a lower cap 74 attached to a bottom thereof which includes a grease seal 76 extending around main shaft 62 to separate main shaft 62 from lower cap 74 and retain a lubricant within bearing housing 70 while encouraging the rotation of shaft 62. A roller bearing assembly 78 is positioned within bearing housing 70 and extends around main shaft 62 to stabilize main shaft 62 in a vertical position and facilitate the rotation of main shaft 62 within bearing housing 70. A ball bearing assembly 80 is positioned within bearing housing 70 above roller bearing assembly 78 and around main shaft 62 to further stabilize main shaft 62 and facilitate the rotation thereof. An upper cap 82 is fastened to the top end of bearing housing 70 by a plurality of bolts 84. A grease seal 86 extends between upper cap 82 and main shaft 62 to retain the lubricant within bearing housing 70 while encouraging the rotation of shaft 62. An upper eccentric weight 88 is attached to main shaft 62 above upper cap 82 and is held in place by a weight stop 90 and a bolt 92.

Bearing housing plates 72 are attached to annular flange 71 of bearing housing 70 by a plurality of bolts 96. Suspension mounts 28 are secured to bearing housing plate 72 by a threaded stud 98 extending upwardly from suspension mounts 28 and a pair of nuts 100 tightened against the top and bottom surfaces of bearing housing plate 72. A drum mount 102 extends inwardly from an inner surface of drum 10 and is secured to bearing housing plate 72 by bolts 104.

Drum 10 has a tapered side wall 106 and a rounded top peripheral edge 108. A funnel shaped drain 110 is positioned within drum 10 and includes a discharge port 112 extending through side wall 106.

Main rim 12 includes a cylindrical shaped side wall 114 having an outwardly extending bubbled rib 116 and a rounded top peripheral edge 118. Main rim 12 sits on drum 10 whereby bubbled rib 116 engages rounded top peripheral edge 108 of drum 10 to support main rim 12 on drum 10. A main rim clamp ring 120 extends around side wall 114 of main rim 12 and is tightened thereto using a T-bolt 122. Clamp ring 120 is positioned above and adjacent to bubbled rib 116 and includes a plurality of L-shaped mounting brackets 124 having a hole 126 formed therein. A plurality of pan clamps 128 are attached to the outer surface of side wall 106 of drum 10 and include a hook 130 which extends into hole 126 of mounting brackets 124 to releasably secure main rim 12 to drum 10.

In accordance with one of the features of the invention, an annular ledge 134 extends inwardly from the bottom of side wall 114 of main rim 12 to support a screen assembly 136 thereon. Screen assembly 136 includes a circular mesh screen 138 having a solid ring-shaped screen frame 140 extending around a periphery thereof. Screen frame 140 is resiliently mounted on ledge 134 to support mesh screen 138 above drain 110. In the preferred embodiment, mesh screen 138 is stainless steel and has a range of 20 to 635 microns, but may be formed of other materials and sizes without affecting the spirit of the invention.

Figure 2:
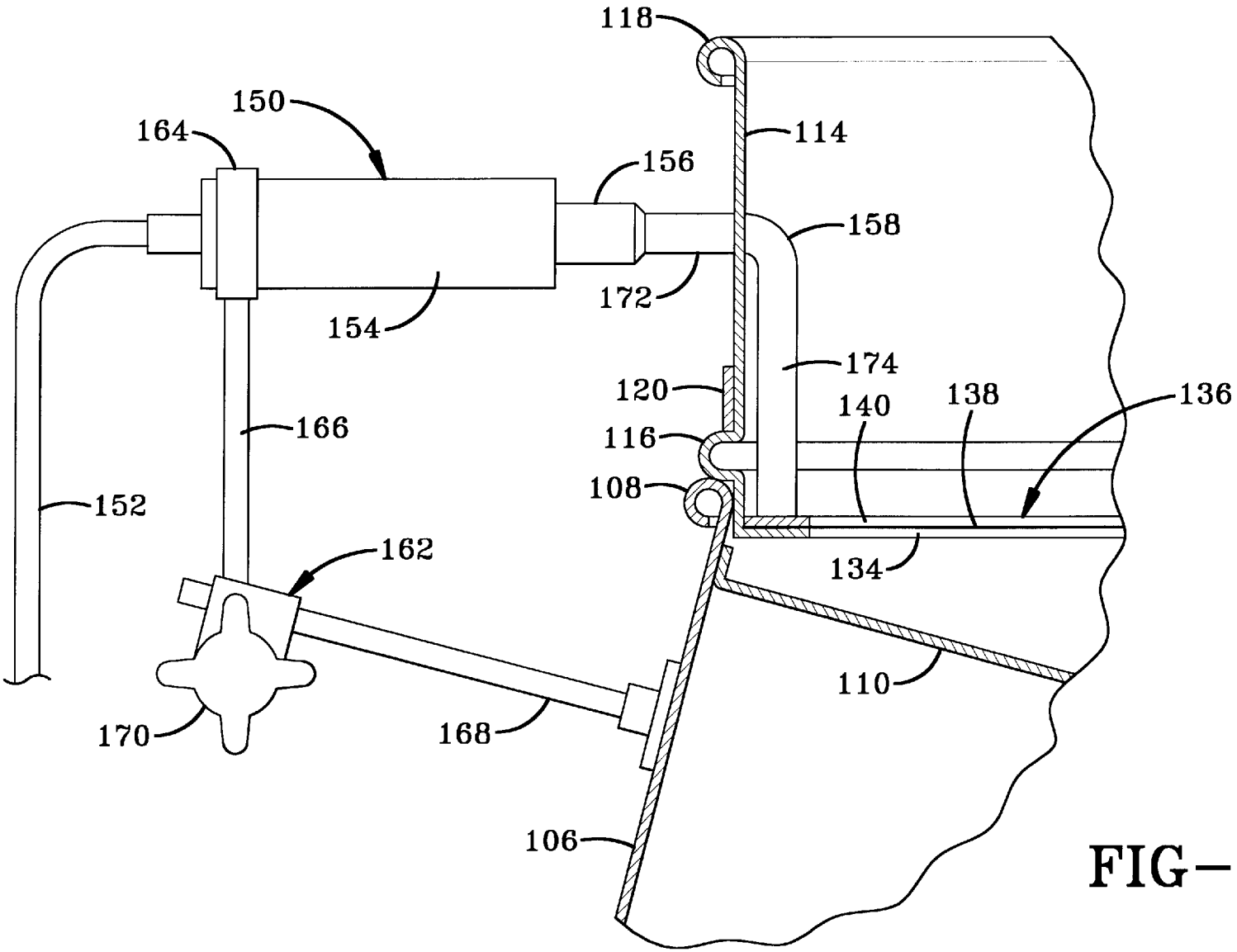
FIG. 2 is an enlarged fragmentary sectional view taken along line 2—2, FIG. 1.

In accordance with another of the features of the invention, ultrasonic vibrational device 6 is used to vibrate mesh screen 138 at ultrasonic frequencies. Ultrasonic vibrational device 6 includes an ultrasonic processor 142 (FIG. 1) having an on/off switch 144, a control knob 146 and an output display 148. An ultrasonic probe 150 is driven by processor 142 and connected thereto by a cable 152. Probe 150 (FIG. 2) includes a cylindrical handle or body portion 154, a neck 156, and an L-shaped probe tip 158 having first and second portions 172 and 174, respectively. A circular hole 160 is formed in side wall 114 of main rim 12 (FIG. 1) through which first portion 172 of probe tip 158 extends. Ultrasonic probe 150 is held in place by a probe clamp 162 having a circular-shaped clamp end 164 extending around handle 154 of probe 150, a rod 166 attached to clamp 164, a clamp support 168 rigidly mounted to side wall 106 of drum 10, and an adjustment knob 170 used to selectively adjust the position of rod 166 along clamp support 168. Probe tip 158 may be manufactured from a variety of material, but in the preferred embodiment, probe tip 158 is manufactured of stainless steel, titanium or aluminum.

Probe tip 158 touches an upper surface of screen frame 140 and may be butted against screen frame 140 with no rigid attachment thereto. Alternatively, probe tip 158 may be glued, welded, braised, soldered or screwed into screen frame 140 without departing from the spirit of the present invention. Handle 154 and neck 156 are supported generally horizontally by probe clamp 162 to allow first portion 172 of probe tip 158 to extend horizontally through hole 160 and second portion 174 of probe tip 158 to extend downwardly and rest against screen frame 140.

In use, motor 38 rotates a drive shaft 52 of low frequency vibrational device 16 causing main shaft 62 to rotate lower and upper eccentric weights 68 and 88, respectively. In the preferred embodiment, motor 38 operates at approximately 3450 RPMs and upper and lower eccentric weights 88 and 68, respectively, generates a vibratory motion within base 8 and drum 10. A material to be sieved is placed upon mesh screen 138 within main rim 12 and the low frequency vibration effected by the oscillation of base 8, drum 10 and main rim 12 provides bulk movement of the material on mesh screen 138. Ultrasonic vibrational device 6 serves to vibrate screen frame 140 at a high frequency. The ultrasonic vibrations transmits around solid ring-shaped screen frame 140 which, in turn, vibrates mesh screen 138.

By vibrating mesh screen 138 from the periphery inwardly, the vibrations converge to a center of the mesh screen which mitigates any dissipation in the vibrational waves. Prior art wave rotors which vibrate the mesh screen from the center outwardly lose a substantial portion of the amplitude of the vibrational waves as the waves travel from the center of the screen outwardly to the periphery of the screen. This dissipation in the vibrational waves is reduced by the sieving device of the present invention which vibrates the screen from a periphery thereof inwardly thus reducing the radial surface area to be vibrated causing the vibrational waves to converge and combine strengthening the vibrational energy and reducing the effects of dissipation and attenuation of the high frequency vibrational waves.

Additionally, ultrasonic vibrational drive 6 can be retrofit to existing sieves by forming a hole in side wall 114 of main rim 12 a distance above screen assembly 136 sufficient to allow probe tip 158 to extend horizontally therethrough and downwardly to rest on screen frame 140. The nonrigid attachment of probe 150 to screen frame 140 allows probe 150 to be easily removed and replaced in the event that probe 150 is damaged or malfunctions. In the preferred embodiment, ultrasonic vibrational device 6 vibrates screen assembly 136 between a range of 5k Hz and 60k Hz and is of the type manufactured by Ultra-sonic Manufacturing—Sonics & Materials of Danbury, Conn., such as their Model VC-54 or VS140, but may be of various types sufficient to produce vibrations within the desired range.

Accordingly, low frequency vibrational drive 16 vibrates base 8, drum 10 and main rim 12 at a low frequency while ultrasonic probe 150 on screen frame 140 to vibrate mesh screen 138 at ultrasonic high frequencies. Screen assembly 136 is resiliently mounted on ledge 134 to allow screen assembly 136 to freely vibrate thereon and to be easily removed, cleaned and replaced. Probe tip 158 touches and rests on screen frame 140 free of rigid attachment thereto to vibrate screen frame 140 and a periphery of mesh screen 138 sieving the material contained within main rim 12 for discharge through duct 112.

Figure 4:
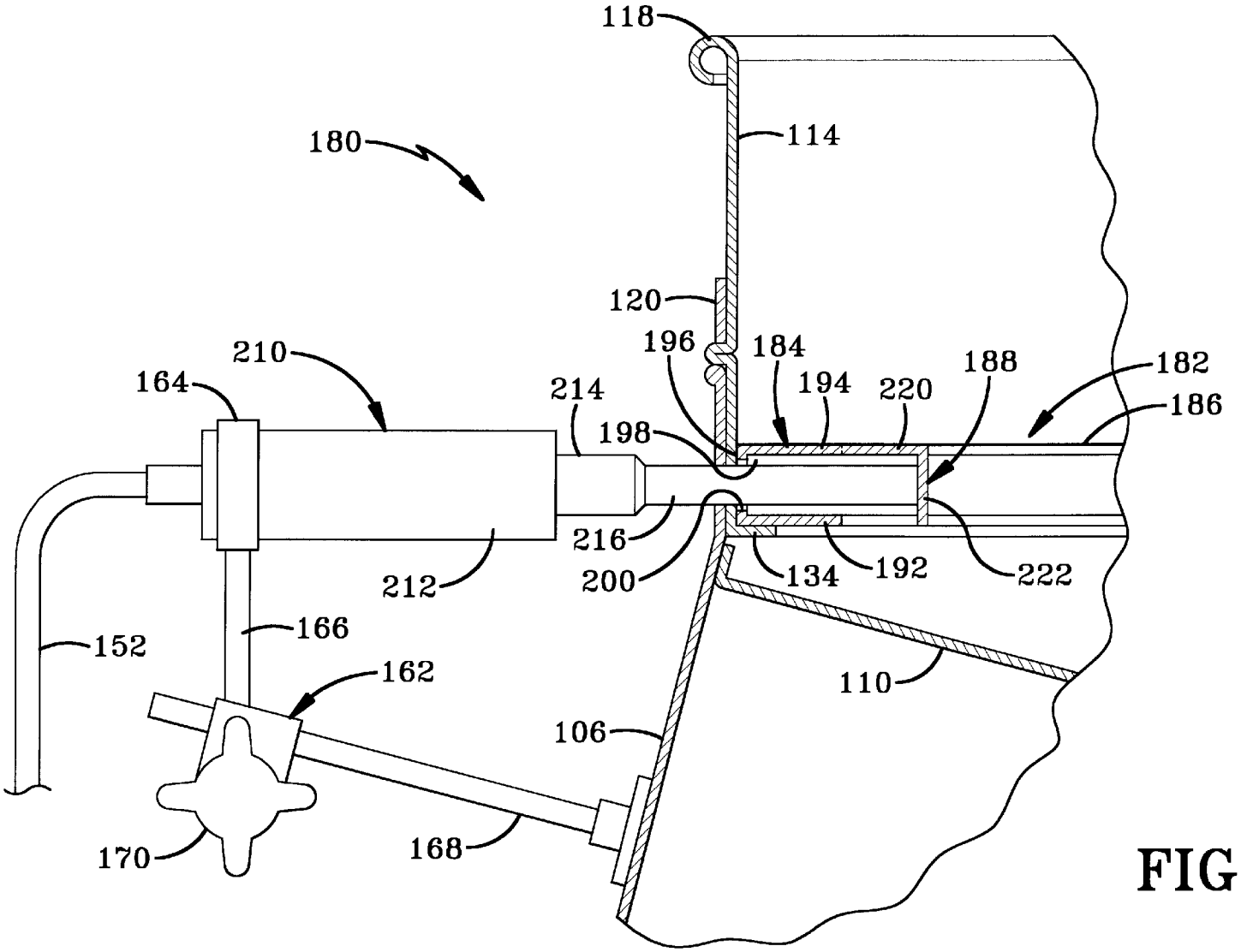
FIG. 4 is an enlarged fragmentary sectional view of a second embodiment of the sieving device of the present invention.

A second embodiment of the sieving device of the present invention is shown in FIG. 4 and is indicated generally at 180. Sieve 180 includes a screen assembly 182 having a raised screen frame 184, a mesh screen 186 similar to mesh screen 138 of sieving device 1 and an L-shaped tab 188 extending inwardly and downwardly from screen frame 184. Screen frame 184 includes a horizontal bottom section 192, a horizontal top section 194 and a vertical middle section 196 extending between and connected to both top and bottom sections 194 and 192, respectively. Horizontal sections 192 and 194 and vertical section 196 form a generally U-shaped channel 198 therebetween. A circular hole 200 is formed in sidewall 106 of drum 10, sidewall 114 of main rim 12 and vertical section 196 of screen frame 184. Sieving device 180 has a probe 210 generally similar to probe 150 of sieving device 1 and having a cylindrical handle or body portion 212, a neck 214, and a straight cylindrical probe tip 216. Probe tip 216 of probe 210 extends outwardly from neck 214 in a straight configuration, unlike the L-shaped probe tip 158 of sieving device 1. L-shaped tab 188 has an inwardly extending horizontal portion 220 and a downwardly vertical extending section 222. Horizontal portion 220 extends inwardly from and is attached to horizontal top section 194 of screen frame 184 whereby vertical portion 222 of tab 188 aligns with hole 200. Probe 210 is mounted on probe clamp 162 to allow probe tip 210 to extend through hole 200 and abut vertical portion 222 of tab 188. In the preferred embodiment, probe tip 216 merely touches or abuts vertical portion 222 but may also be welded, glued, screwed, brazed or soldered to tab 188 without affecting the concept or spirit of the invention.

Probe 210 and particularly probe tip 216 thereof vibrates at an ultrasonic frequency and, in turn, vibrates L-shaped tab 188. Because L-shaped tab 188 is connected to horizontal top section 194 of screen frame 184, the vibrational energy of ultrasonic vibrational device 6 is transferred to screen frame 184 to vibrate mesh screen 186 around a periphery thereof. Mesh screen 186 rests on horizontal portion 220 of tab 188 causing a slight amount of additional vibration of the screen.

Figure 5:
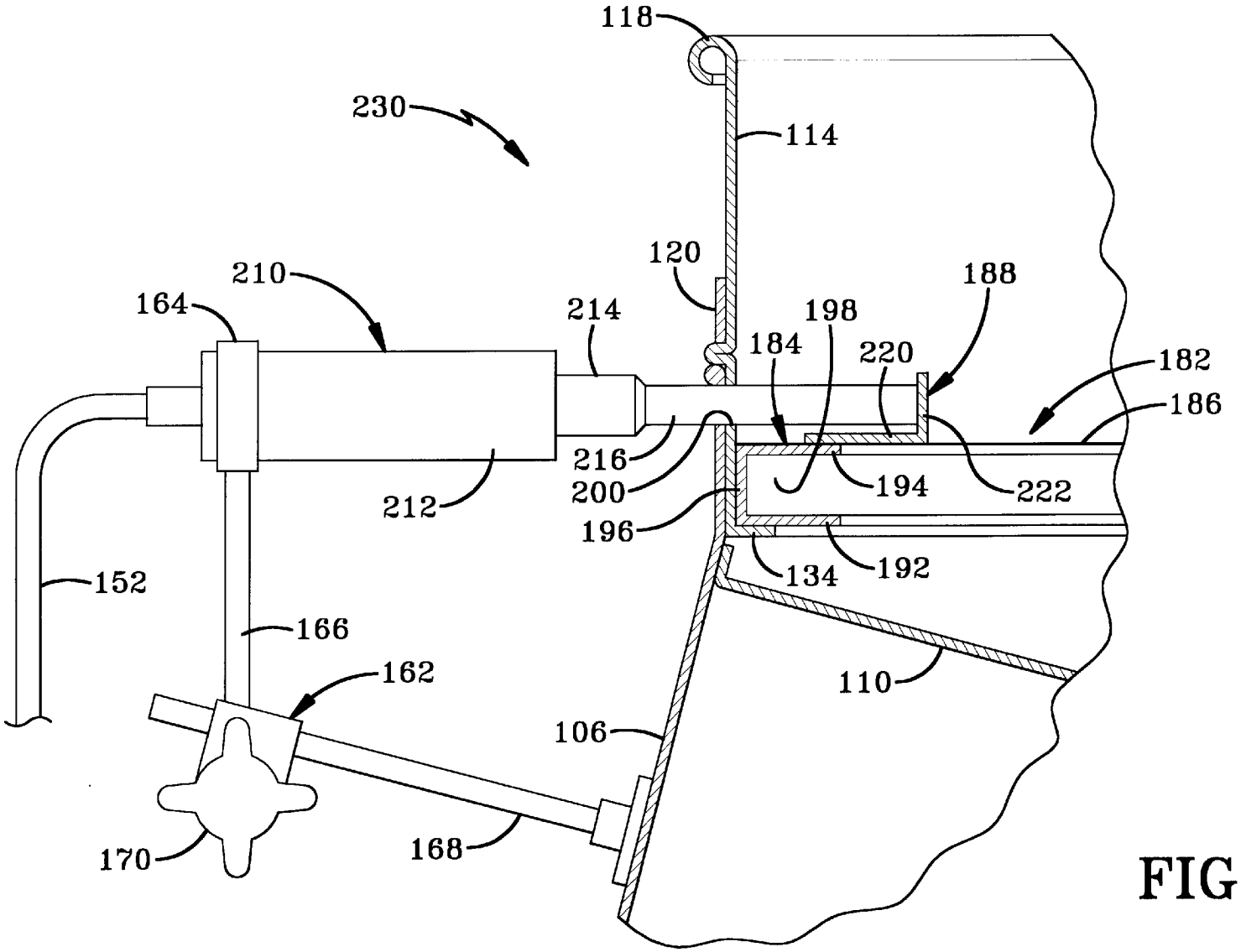
FIG. 5 is an enlarged fragmentary sectional view of a third embodiment of the sieving device of the present invention.

A third embodiment of the sieving device of the present invention is shown in FIG. 5 and is indicated generally at 230. Sieving device 230 is generally similar to sieving device 180 except L-shaped tab 188 extends inwardly and upwardly from screen frame 184. Hole 200 is formed slightly higher in sidewalls 106 and 114 and vertical section 196 of screen frame 184 is free of hole 200. Straight probe tip 216 extends through hole 200 and abuts vertically upwardly extending portion 222 of tab 188. Horizontal portion 220 of tab 188 is connected to the top surface of top section 194 of screen frame 184. Screen 186 extends around tab 188 allowing tab 188 to be welded or otherwise attached directly to screen frame 184. Alternatively, because screen 186 is formed of a metal and is a mesh, tab 188 may be welded directly through screen 186 and attached to screen frame 184. Sieving device 230 operates in a similar manner to sieving device 180 whereby in the preferred embodiment, probe tip 216 merely abuts and touches vertical portion 222 of tab 188 and is free of rigid attachment thereto and vibrates tab 188, which in turn, vibrates screen frame 184 and screen 186.

Accordingly, the improved ultrasonic sieving device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved ultrasonic sieving device is constructed and used, the characteristics of the construction, and the advantageous, new and useful results obtained; the new and useful structures, devices, elements, arrangements, parts and combinations, are set forth in the appended claims.

We claim:

1. A sieving device comprising:

a base;

a drum resiliently mounted on the base;

a first vibrational drive positioned within the base and attached to the drum;

a rim mounted on the drum;

a screen assembly positioned within the rim, said screen assembly includes a mesh screen and a frame having a top surface, said frame extends around a periphery of said mesh screen;

ultrasonic vibrational means for vibrating the mesh screen assembly at an ultrasonic frequency; and said ultrasonic vibrational means directly abutting said frame internally to said rim.

2. The sieving device defined in claim 1 in which the ultrasonic means abuts the top surface of the frame removably and free of rigid attachment thereto.

3. The sieving device defined in claim 2 in which the ultrasonic means includes a probe and an ultrasonic processor which induces a vibrational signal within the probe.

4. The sieving device defined in claim 3 in which the probe abuts the top surface of the frame free of rigid attachment thereto.

5. The sieving device defined in claim 4 in which a ledge extends inwardly around a periphery of the rim; and in which the screen assembly is resiliently supported on said ledge.

6. The sieving device defined in claim 5 in which the mesh screen is circular-shaped; and in which the frame is a solid annular-shaped ring attached to the periphery of the mesh screen.

7. The sieving device defined in claim 6 further including a probe clamp which rigidly mounts the probe to the drum.

8. A sieving device comprising:

a base;

a drum resiliently mounted on the base;

a first vibrational drive positioned within the base and attached to the drum;

a rim mounted on the drum;

a screen assembly positioned within the rim, said screen assembly including a mesh screen and a frame having a top surface, said frame extending around a periphery of said mesh screen;

ultrasonic vibrational means which abuts the frame within an interior of the rim for vibrating the mesh screen assembly at an ultrasonic frequency;

said ultrasonic means abuts the top surface of the frame free of rigid attachment thereto;

the ultrasonic means includes a probe and an ultrasonic processor which induces a vibrational signal within the probe;

the probe abuts the top surface of the frame free of rigid attachment thereto;

a ledge extending inwardly around a periphery of the rim; and in which the screen assembly is resiliently supported on said ledge;

the mesh screen being circular-shaped; and the frame being a solid annular-shaped ring attached to the periphery of the mesh screen;

a probe clamp rigidly mounting the probe to the drum; and in which the probe is generally L-shaped.

9. The sieving device defined in claim 8 in which a hole is formed in the rim; and in which the probe extends horizontally through said hole to an interior of said rim and vertically downward to abut the frame.

10. The sieving device defined in claim 9 in which the mesh screen has a range of from 20 to 635 microns.

11. The sieving device defined in claim 10 in which the probe vibrates the screen assembly in a range of 5 kHz to 60 kHz.

12. The sieving device defined in claim 11 in which the probe tip is rigidly secured to the solid annular shaped ring.

* * * * *